United States Patent [19]

O'Halloran

[11] 4,454,623

[45] Jun. 19, 1984

[54] TOOTHBRUSH

[75] Inventor: James O'Halloran, Tortola, British Virgin Isls.

[73] Assignee: Radius Corporation, New York, N.Y.

[21] Appl. No.: 406,216

[22] Filed: Sep. 8, 1982

[51] Int. Cl.[3] ..... A46B 9/04

[52] U.S. Cl. ..... 15/167 R; 15/143 R; D4/25

[58] Field of Search ..... 15/143 R, 143 B, 145, 15/110, 176, 172, 167 R; D4/25

[56] References Cited

U.S. PATENT DOCUMENTS

| | | | |
|---|---|---|---|
| 2,056,447 | 10/1936 | Fell | 15/167 R |
| 2,094,240 | 9/1937 | Herrick et al. | 15/167 R |
| 4,351,080 | 9/1982 | Grossman | 15/167 R |

FOREIGN PATENT DOCUMENTS

| | | | |
|---|---|---|---|
| 2840429 | 5/1980 | Fed. Rep. of Germany | 15/143 R |

*Primary Examiner*—Peter Feldman

*Attorney, Agent, or Firm*—Darby & Darby

[57] ABSTRACT

A toothbrush comprises a handgrip formed on one side with a substantially plane fingerrest and a concave thumbrest and on an adjacent side with a palmrest including a convex portion spaced apart from the thumbrest and a substantially linear portion adjacent to the thumbrest. A neck is connected to the handgrip, and a head is connected to the neck. The head is formed with a substantially plane wide oval-shaped bristle-supporting surface and includes soft flexible bristles extending outward from the bristle-supporting surface. The neck has an axis that is angularly displaced with respect to an extension of the linear palmrest portion through an acute neck angle, the angular displacement of the neck axis being clockwise for a right-hand brush or counterclockwise for a left-hand brush, as seen from the side of the toothbrush on which the fingerrest and the thumbrest are located. The bristle-supporting surface is angularly displaced with respect to the neck axis through an acute crank angle and with respect to the plane of the finger rest surface through an acute rotation angle. The angular displacement of the bristle-supporting surface is, in the case of the crank angle, counterclockwise for a right-hand brush or clockwise for a left-hand brush, as seen from the side of the toothbrush opposite the palmrest. In the case of the rotation angle, the displacement of the bristle-supporting surface is clockwise for a right-hand brush or counterclockwise for a left-hand brush, as seen from the head end of the toothbrush.

16 Claims, 8 Drawing Figures

TOOTHBRUSH

BACKGROUND OF THE INVENTION

This invention relates to toothbrushes and, more particularly, to a novel and highly-effective toothbrush that is easier and more pleasurable to use than conventional toothbrushes.

Caries and the inflammatory periodontal diseases are among the most prevalent chronic diseases in the world. Both require colonization of bacteria on exposed tooth surfaces. Neither can develop in the absence of microbial plaque. Health will prevail as long as the host is able to effectively remove this plaque.

The relationship between the presence of plaque microorganisms at the gingival sulcus (crevice) and periodontal disease has been well documented. If the gingival crevice is rendered completely plaque-free, any existing disease activity will cease and the periodontium will become healthy. Clearly, any method of plaque control must include effective sulcular brushing.

Although effective oral hygiene includes proper diet, regular flossing and regular professional care, regular and careful brushing is the single most effective means to clean the mouth and teeth, to stimulate gingival tissue and to remove plaque from both supra- and subgingival surfaces. Brushes specially designed for this purpose have been known for years, but all conventional toothbrushes have drawbacks that render them less effective, less easy and less comfortable to use than one would wish.

One drawback of conventional brushes is that the bristles do not cover a large enough area to effectively clean the teeth and gums in a reasonable time; or create a pleasurable sensation—the sensation of effectively cleaning and massaging the mouth, teeth and gums.

Secondly, conventional brushes do not inherently address the brushing of the gingival crevice in order to remove plaque adjacent to and directly beneath the gingival margin. Conventional brushes must be contorted at a forty-five degree angle (known as the Bass method) in order to reach the gingival crevice.

Furthermore, with conventional brushes it is necessary for the user to rotate the brush in order to brush opposite surfaces of the teeth. Consequently, conventional brush handles, designed for easy rotation in the hand, are generally narrow and symetric. Furthermore, conventional toothbrush heads are long and narrow, usually the bristle height exceeding the bristle width. Combined, this configuration tends to produce a brush which is unstable and slips or rotates unnecessarily. Consequently, the brush must be held with considerable force and is not comfortable to the fingers and hand.

SUMMARY OF THE INVENTION

An object of the invention is to provide a toothbrush that is easier, more effective and more pleasurable to use; remedying the above shortcomings of conventional toothbrushes.

In particular, an object of the invention is to provide a toothbrush having bristles that treat large areas, and furthermore, without consequent strain to the fingers as they grip the brush.

Furthermore, an object of the invention is to effectively remove plaque from the gingival cavity in ordinary brushing (without unduly contorting the brush, i.e., at forty-five degrees).

Furthermore, an object of the invention is to provide a brush that can be held lightly and easily and can still resist unwanted slipping or rotation in the hand.

The foregoing and other objects are attained in accordance with the invention by providing a toothbrush comprising (1) a handgrip formed on one side with a substantially plane fingerrest and a concave thumbrest and on an adjacent side with a palmrest including a convex portion spaced apart from the thumbrest and a substantially linear portion adjacent to the thumbrest. A neck is connected to the handgrip, and a head is connected to the neck. The head is formed with a substantially plane bristle-supporting surface and includes bristles extending outward from the bristle-supporting surface.

In accordance with the invention, the neck has an axis that is angularly displaced with respect to an extension of the linear palmrest portion, through an acute neck angle. The angular displacement of the neck axis is clockwise in the case of a brush intended for use in the right hand (a "right-hand brush") and counterclockwise in the case of a brush intended for use in the left hand (a "left-hand brush"), as seen from the side of the toothbrush on which the fingerrest and the thumbrest are located.

The bristle-supporting surface is angularly displaced with respect to the plane of the fingerrest surface through an acute crank angle and an acute rotation angle.

The angular displacement of the bristle-supporting surface is, in the case of the crank angle of a right-hand brush, counterclockwise, and in the case of a left-hand brush, clockwise, as seen from the side of the toothbrush opposite the palmrest.

The angular displacement of the bristle-supporting surface is, in the case of the rotation angle, either clockwise as seen from the head end of the toothbrush, whereby the toothbrush is adapted for right-hand use, or counterclockwise as seen from the head end of the toothbrush, whereby the toothbrush is adapted for left-hand use.

The neck angle mentioned above is within the range of 25° to 50° and is preferably substantially 38°; the crank angle mentioned above is within the range of 5° to 15° and is preferably substantially 10°; and the rotation angle mentioned above is within the range of 8° to 18° and is preferably substantially 13°.

The handgrip is sized to substantially fill the hand of a user. The bristle-supporting surface is substantially oval and has a major axis and a minor axis, the major axis being more nearly parallel than the minor axis to the neck axis mentioned above.

The bristle-supporting surface is in part elevated with respect to the plane of the neck and the finger rest surface, and the bristles form an array sized to extend from the upper gingiva to the lower gingiva of a user, the user's teeth being clenched. The bristles are moreover made of soft polished nylon, end rounded, straight trimmed and arranged in a multitufted oval pattern.

BRIEF DESCRIPTION OF THE DRAWING

A better understanding of the invention may be gained from a consideration of the following detailed description of the preferred embodiments thereof, in conjunction with the appended figures of the drawing, wherein.

DESCRIPTION OF THE PREFERRED EMBODIMENTS

Figure 1:
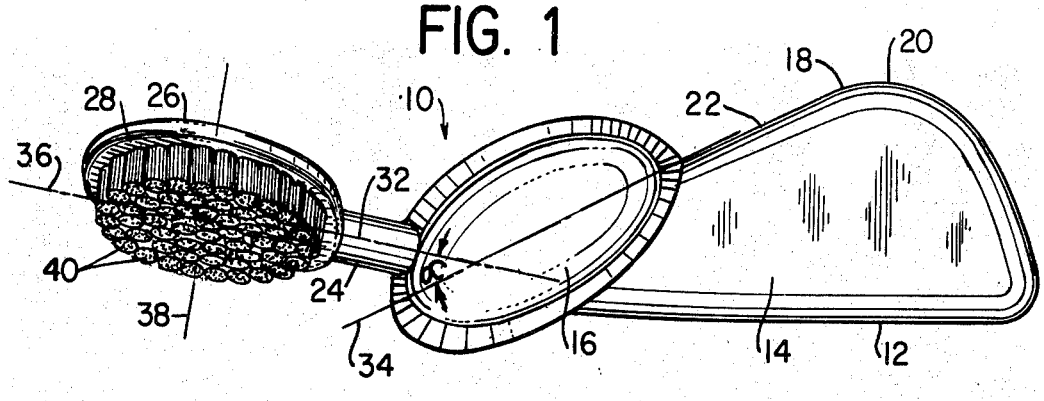
FIG. 1 is a top plan view of a right-hand toothbrush constructed in accordance with the invention.

FIGS. 1–5 show a toothbrush 10 adapted for right-hand use. The toothbrush 10 comprises a handgrip 12 formed on one side with a substantially plane fingerrest 14 and a concave thumbrest 16 and on an adjacent side with a palmrest 18 including a convex portion 20 spaced apart from the thumbrest 16 and a substantially linear portion 22 adjacent to the thumbrest 16.

The toothbrush 10 also includes a neck 24 connected to the handgrip 12 and a head 26 connected to the neck 24. The head is formed with a substantially plane bristle-supporting surface 28 and includes bristles 30 extending outward from the bristle-supporting surface 28.

The neck 24 has an axis 32 that is angularly displaced with respect to an extension 34 of the linear palmrest portion 22 through an acute neck angle $\alpha$. The angular displacement of the neck 24 or the neck axis 32 is clockwise in the right-hand brush 10 of FIG. 1, as seen from the side of the toothbrush 10 on which the fingerrest 14 and the thumbrest 16 are located.

Figure 2:
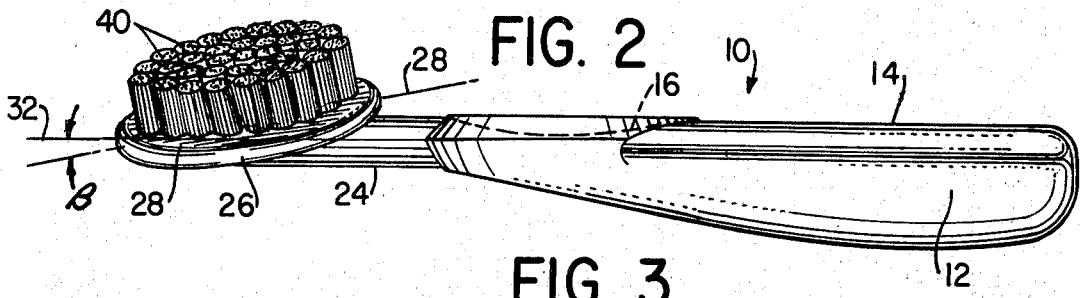
FIG. 2 is a left side elevation of the right-hand toothbrush of FIG. 1.
Figure 3:
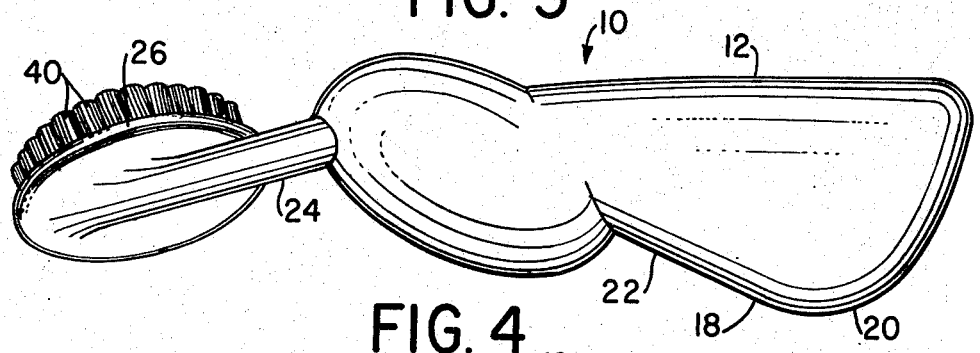
FIG. 3 is a bottom plan view of the toothbrush of FIG. 1.
Figure 4:
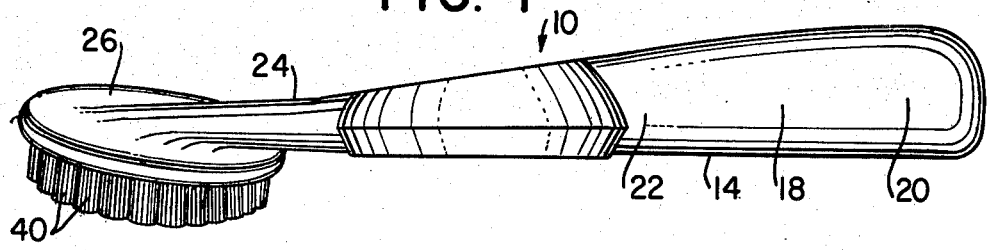
FIG. 4 is a right side elevation of the toothbrush of FIG. 1.

The bristle-supporting surface 28 is angularly displaced with respect to the neck axis 32 through an acute crank angle $\beta$ (FIG. 2). The surface 28 is angularly displaced with respect to the plane of the palmrest surface 14 through an acute rotation angle $\gamma$ (best shown in FIG. 5).

Figure 5:
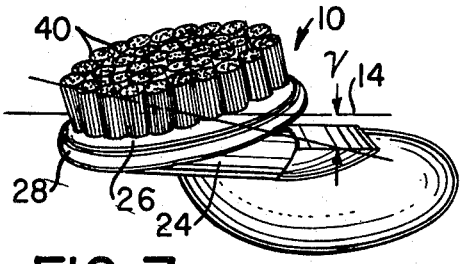
FIG. 5 is a head-end elevation of the toothbrush of FIG. 1.

The angular displacement of the bristle-supporting surface 28 is, in the case of the crank angle of a right-hand brush, counterclockwise as seen from the side of the toothbrush opposite the palmrest 18 (FIG. 2). The angular displacement of the bristle-supporting surface 28 is, in the case of the rotation angle $\gamma$ of a right-hand brush, clockwise as seen from the head end of the toothbrush (FIG. 5).

Figure 6:
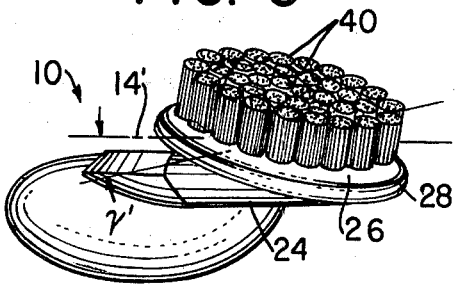
FIG. 6 is a head-end elevation of an alternative embodiment of the toothbrush of FIG. 1, which is a mirror image thereof adapted for left-hand use.

Alternatively, the polarities of the angular displacements described above can all be reversed, whereby the toothbrush 10' (FIG. 6) is adapted for left-hand use. Specifically, the angular displacement $\alpha'$ of the neck axis 32' with respect to the extension line 34' is counterclockwise (FIG. 7); the angular displacement $\beta'$ of the bristle-supporting surface 28' with respect to the neck axis 32' is clockwise; and the angular displacement $\gamma'$ of the surface 28' with respect to the plane of the palmrest surface 14' is counterclockwise, the perspectives in each case being defined the same for a left-hand brush as for a right-hand brush. Various views of a left-hand brush can be seen by examining FIGS. 1–5 in a mirror. FIG. 6 is of course a mirror image of FIG. 5.

Figure 7:
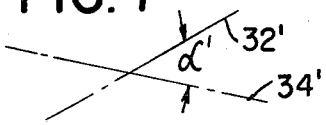
FIGS. 7 and 8 are diagrams of certain angles characterizing the left-hand brush of FIG. 6.
Figure 8:
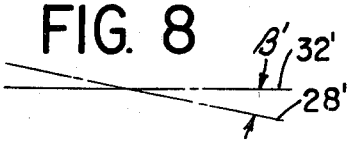

The neck angle $\alpha$ or $\alpha'$ is within the range of 25 degrees to 50 degrees and is preferably substantially 38 degrees, as indicated best in FIG. 1 and 7. The crank angle $\alpha$ or $\alpha'$ is within the range of 5 degrees to 15 degrees, and is preferably substantially 10 degrees, as indicated in FIGS. 2 and 8; and the rotation angle $\gamma$ or $\gamma'$ is within the range of 8 degrees to 18 degrees and is preferably substantially 13 degrees, as indicated in FIGS. 5 and 6, respectively.

The handgrip 12 is sized to substantially fill the hand of a user. The toothbrush 10 or 10' can thus be made in adult or junior sizes so that all members of the public can obtain a properly-sized toothbrush. The bristle-supporting surface 28 is oval and has a major axis 36 and a minor axis 38 (FIG. 1), the major axis 36 being more nearly parallel than the minor axis 38 to the neck axis 32. Moreover, the bristle-supporting surface 28 is elevated in part with respect to the plane of the neck and the fingerrest surface 14, as FIG. 2 best shows.

The bristles 30 form an array sized in width to extend from the upper gingiva to the lower gingiva of the user, the user's teeth being clenched; and the bristles 30 are made of soft polished nylon, end rounded, straight trimmed and arranged in a multi-tufted oval pattern.

Because of the structure of the toothbrush described above, and in particular the wide oval head (the bristle area being about twice the width of a conventional brush while remaining about the same length), the bristles cover an area large enough to effectively clean the teeth and gums in a few minutes time. The greater area of the soft flexible bristles contributes to a sensation of pleasure and effective cleaning and massaging of the mouth, teeth and gums.

The greater width of the head enables the user to clean and massage the upper and lower facial (outside) surfaces of the teeth and gums at the same time. As the oval shaped head rides back and forth (rather than up and down) in short vibratory strokes currently recommended by dentists (Bass method but without the forty-five degree contortion), the bristles at the point of greatest width tend to splay outwardly and enter the gingival crevice at an angle sympathetic to the shape of the crevice and are effective in removing debris and plaque from the crevice. The effective splaying of the bristles at the point of greatest width is a phenomena of the oval shape of the head and bristle pattern.

Furthermore, the great width of the head and the large assymetrical hand grip and thumb rest cause the brush to be inherantly stable and enable the user to resist unwanted rotation and to delicately control the brush while gripping it only lightly. The delicate light touch with which the brush can be effectively manipulated and the large palm, finger and thumb rest surfaces contribute to the pleasure and comfort of the user and tend to promote a more positive attitude toward brushing. This should contribute to more frequent, effective brushing habits.

Furthermore, the head of the brush has been elevated, angled, cranked and rotated in relation with the handle so that most surfaces of the teeth and gums can be brushed effectively without rotating the brush in the hand in order to reach opposite sides (as is necessary with a conventional brush fifty percent of the time). The brush therefore being assymetrical is necessarily promoted in right and left hand versions.

Thus there is provided in accordance with the invention a novel and highly-effective toothbrush that is easier and more pleasurable to use than conventional toothbrushes. Many modifications of the preferred embodiments disclosed above will readily occur to those skilled in the art upon considering this disclosure. Accordingly, all such structure is intended to be included within the scope of the appended claims.

What is claimed is:

1. In a toothbrush comprising (1) a handgrip formed on one side with a substantially plane fingerrest and a concave thumbrest and on an adjacent side with a palmrest including a convex portion spaced apart from said thumbrest and a substantially linear portion adjacent to said thumbrest, (2) a neck connected to said handgrip, and (3) a head connected to said neck, said head being formed with a substantially plane bristle-supporting surface and including bristles extending outward from said bristle-supporting surface, the improvement wherein said neck has an axis that is angularly displaced with respect to an extension of said linear palmrest portion through an acute neck angle and said bristle-supporting surface is angularly displaced with respect to said neck axis through an acute crank angle and with respect to the plane of said fingerrest surface through an acute rotation angle.

2. A toothbrush according to claim 1 wherein said angular displacement of said neck axis is clockwise as seen from the side of said toothbrush on which said fingerrest and said thumbrest are located and said angular displacement of said bristle-supporting surface is, in the case of said crank angle, counterclockwise as seen from the side of said toothbrush opposite said palmrest and, in the case of said rotation angle, clockwise as seen from the head end of said toothbrush, whereby said toothbrush is adapted for right-hand use.

3. A toothbrush according to claim 1 wherein said angular displacement of said neck axis is counterclockwise as seen from the side of said toothbrush on which said fingerrest and said thumbrest are located and said angular displacement of said bristle-supporting surface is, in the case of said crank angle, clockwise as seen from the side of said toothbrush opposite said palmrest and, in the case of said rotation angle, counterclockwise as seen from the head end of said toothbrush, whereby said toothbrush is adapted for left-hand use.

4. A toothbrush according to claim 1 wherein said neck angle is within the range of 25° to 50°.

5. A toothbrush according to claim 1 wherein said neck angle is substantially 38°.

6. A toothbrush according to claim 1 wherein said crank angle is within the range of 5° to 15°.

7. A toothbrush according to claim 1 wherein said crank angle is substantially 10°.

8. A toothbrush according to claim 1 wherein said rotation angle is within the range of 8° to 18°.

9. A toothbrush according to claim 1 wherein said rotation angle is substantially 13°.

10. A toothbrush according to claim 1 wherein said neck angle is within the range of 25° to 50°, said crank angle is within the range of 5° to 15°, and said rotation angle is within the range of 8° to 18°.

11. A toothbrush according to claim 1 wherein said neck angle is substantially 38°, said crank angle is substantially 10°, and said rotation angle is substantially 13°.

12. A toothbrush according to claim 1 wherein said handgrip is sized to substantially fill the hand of a user.

13. A toothbrush according to claim 1 wherein said bristle-supporting surface is substantially oval and has a major axis and a minor axis, said major axis being more nearly parallel than said minor axis to said neck axis.

14. A toothbrush according to claim 1 wherein said bristle-supporting surface is in part elevated with respect to said plane of said finger rest surface.

15. A toothbrush according to claim 1 wherein said bristles form an array sized in width to extend from the upper gingiva to the lower gingiva of a user, the user's teeth being clenched.

16. A toothbrush according to claim 1 wherein said bristles are made of soft nylon and arranged in a multi-tufted oval pattern.

* * * * *